US005851497A

United States Patent [19]

Brooker et al.

[11] Patent Number: 5,851,497

[45] Date of Patent: Dec. 22, 1998

[54] GASIFIER THROAT

[75] Inventors: Donald Duane Brooker, Hopewell Junction, N.Y.; James Samuel Falsetti, New Fairfield, Conn.; James Kenneth Wolfenbarger, Tujunga, Calif.; Dinh-Cuong Vuong, Sugar Land, Tex.

[73] Assignee: Texaco Inc., White Plains, N.Y.

[21] Appl. No.: 656,214

[22] PCT Filed: Nov. 18, 1994

[86] PCT No.: PCT/US94/13377

§ 371 Date: Jul. 17, 1996

§ 102(e) Date: Jul. 17, 1996

[87] PCT Pub. No.: WO95/14527

PCT Pub. Date: Jun. 1, 1995

[51] Int. Cl.[6] ..... F28D 21/00; F22B 37/00; F23J 1/02

[52] U.S. Cl. ..... 422/207; 48/61; 48/68; 48/101; 48/113; 48/62 R; 110/229

[58] Field of Search ..... 422/207, 61, 68, 422/101, 113, 62 R; 110/229

[56] References Cited

U.S. PATENT DOCUMENTS

| | | | |
|---|---|---|---|
| 4,218,423 | 8/1980 | Robin et al. | 422/207 |
| 4,533,363 | 8/1985 | Jahnke et al. | 48/197 R |
| 4,948,387 | 8/1990 | Martin | 48/62 R |
| 5,464,592 | 11/1995 | Brooker et al. | 422/207 |

FOREIGN PATENT DOCUMENTS

| | | |
|---|---|---|
| 4025955 | 1/1991 | Germany . |
| 2033563 | 5/1980 | United Kingdom . |
| 2135434 | 8/1984 | United Kingdom . |

*Primary Examiner*—Tae Yoon
*Attorney, Agent, or Firm*—Henry H. Gibson; Rodman & Rodman

[57] ABSTRACT

A gasifier (10) for partially combusting a carbonaceous fuel mixture in the combustion chamber (13) of the gasifier (10). The latter includes a water bath (26) into which the hot effluent or the products of combustion are immersed, including a synthetic gas. The products of combustion are directed into the bath (26) by way of a constricted throat section (31). To avoid excessive erosion action and/or thermal shock to the throat section (31) as a result of exposure to the effluent's high temperatures, the throat section (31) is structured with an internal framework of pipes (32). The flamework (32) is communicated with a pressurized source of a cooling fluid (42), preferably water, whereby to cool the throat section (31) sufficiently to counteract the ill effects of exposure to contact with the high temperature effluent.

14 Claims, 3 Drawing Sheets

GASIFIER THROAT

BACKGROUND OF THE INVENTION

Field of the Invention

The production of a synthesis gas in a conventional gasifier usually embodies the partial oxidation of a fuel mixture at a relatively high temperature. The resulting products of combustion include the desired synthesis gas, together with an amount of uncombusted effluent.

When the fuel mixture is comprised of a solid material such as coke or coal grounds, the composition of the coke or coal can be such that varying amounts will not be combusted and will be passed through the gasifier and remain as a solid. While a considerable amount of the solid effluent components will be carried into the gasifier quench chamber, at least a part of said solid effluent will be retained on the gasifier walls and form a slag. When in a hot plastic state, the slag will gradually flow down to the gasifier quenching bath, or eventually solidify when the gasifier is closed down and the temperature is reduced.

At some point in the synthetic gas production process, it will be apparent that the presence of an excessive amount of slag within the gasifier is impeding the gasification process. At such time, the gasifier is manually shut down for the specific purpose of melting the slag or of effectuating a deslagging operation.

Such an operation is comprised basically of introducing a combustible mixture to the gasifier's combustion chamber such that when a sufficient elevated temperature is reached, the slag will melt and by gravity flow pass into a quench bath.

One detriment to this procedure becomes apparent, particularly when the partially combusted mixture includes an amount of vanadium in its composition. The subsequent deslagging operation will be impaired by this element's presence most often resulting in damage to the gasifier constricted throat at a greater rate than the rest of the gasifier refractory. The latter will tend to be physically eroded or corroded away by the accumulation of slag about this narrowed portion of the effluent flow path and the thermal shock to which it is often subjected.

Stated briefly, it is therefore, an object of the invention to provide a novel gasifier throat structure which includes a cooling system embodying a circulating medium.

SUMMARY OF THE INVENTION

Toward overcoming a major fault in a gasifier deslagging process, there is presently provided a novel throat section which is capable of resisting the effects of high temperatures and thermal shock, factors which often result in subsequent erosion of the throat. The hereinafter described gasifier throat is comprised primarily of a refractory material capable of withstanding exposure to the normally high temperatures achieved during the gasification process.

The throat, however, is provided with an internal cooling system comprised of a network or a supporting frame of interconnected pipes and/or tubes which carry a liquid cooling medium through the throat. The liquid coolant will be most effective in its cooling function, particularly at the effluent contacting throat face.

DESCRIPTION OF THE INVENTION

Figure 1:
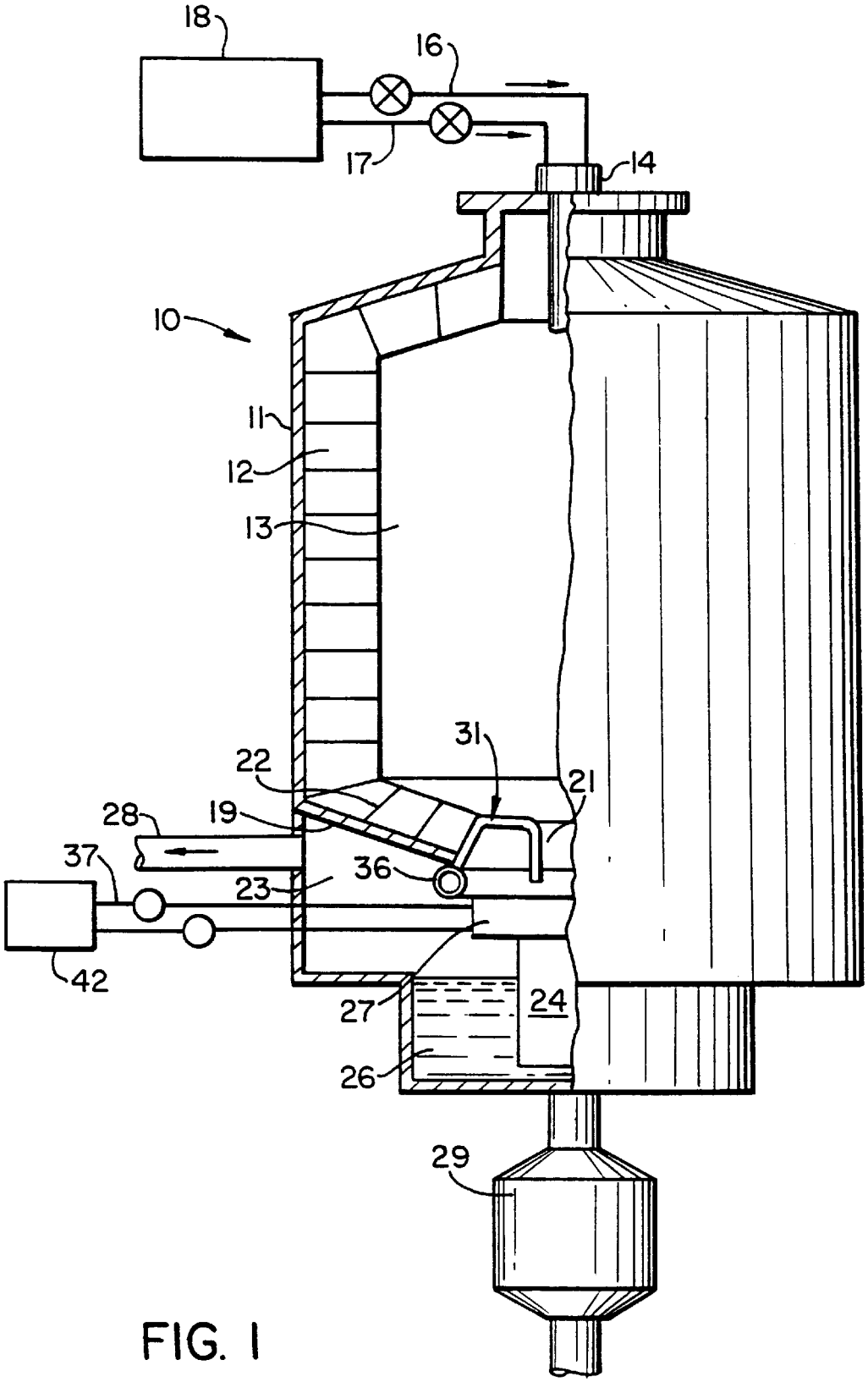
FIG. 1 is a cross-sectional elevation view of a gasifier.

Referring to FIG. 1, a gasifier 10 of the type contemplated is shown which is comprised essentially of an elongated shell 11 having a refractory liner 12 of fire brick or he like, which forms combustion chamber 13 in which partial combustion of an injected fuel mixture takes place.

The upper end of the gasifier is provided for partial oxidation or a deslagging operation with an opening which positions a burner 14. The latter in one embodiment is communicated through one or more valved conduits, such as 16 and 17, to a pressurized source 18 of a fuel or a fuel mixture. The fuel can, for example, comprise particulated coal or coke together with a combustion supporting gas such as oxygen and/or other additives.

The lower end of the gasifier shell 11 includes a floor 19 having a generally conical shape to direct downward flowing hot gaseous products of combustion, as well as solid effluent, into a constricted throat opening 21. Floor 19 constitutes a continuation of shell 11 sidewall and is likewise provided with a refractory layer 22 capable of withstanding the normal combustion chamber temperatures which can achieve a level of approximately 2,500° F.

The function of constricted throat opening 21 is to guide downflowing hot gases or effluent into a quench chamber 23 where both the gases and the solid particulate material will be quenched prior to discharge. Quench chamber 23 includes a dip tube 24 which is spaced below the constricted throat opening 21 and positioned to guide downward flowing gas as well as flowable solid matter into water bath 26.

Dip tube 24 is provided with a quench ring 27 which serves to inject coolant water from an external pressurized source 42 against the walls of the dip tube 24 to protect them from damage as a result of contact with the above noted high temperature gases and solids.

After the quenching process, the synthesis gas, which will normally carry an amount of particulate material with it, is discharged from the gasifier by outlet 28 to one or more heat exchange members for further processing. The solid materials which enter water bath 26, fall by gravity through the bath and are passed into a lock hopper 29 which is periodically emptied to dispose of this solid component.

Figure 2:
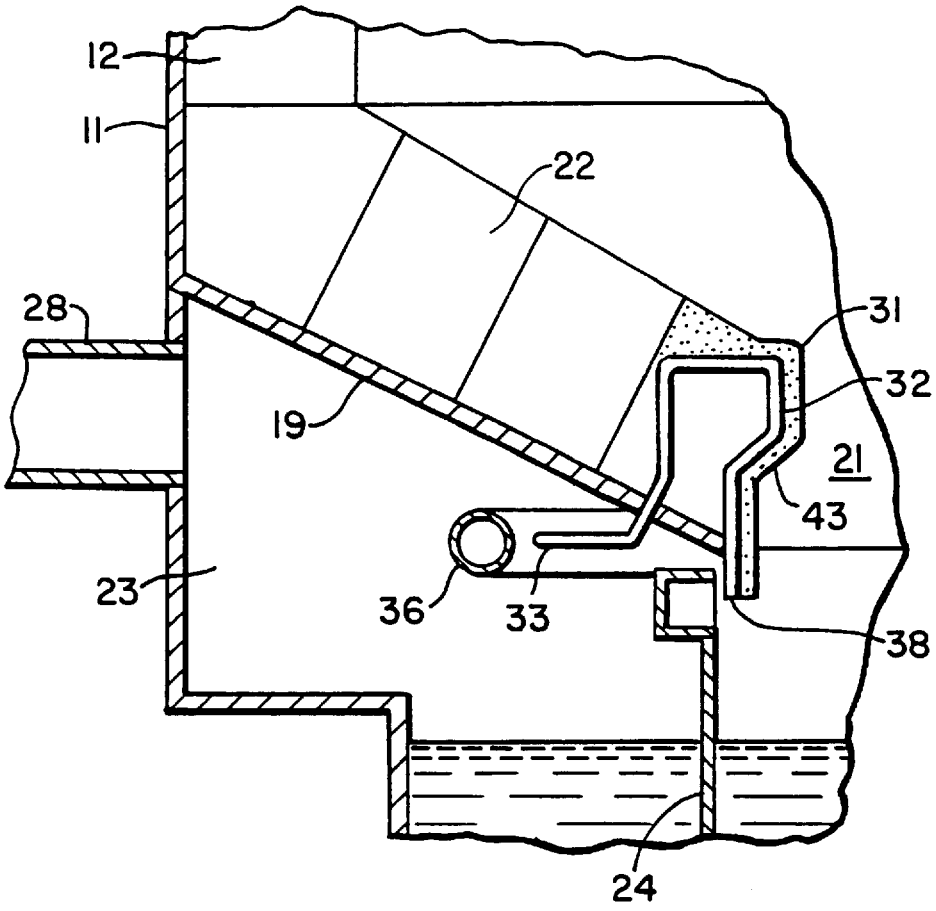
FIG. 2 is an enlarged segmentary view of FIG. 1.
Figure 3:
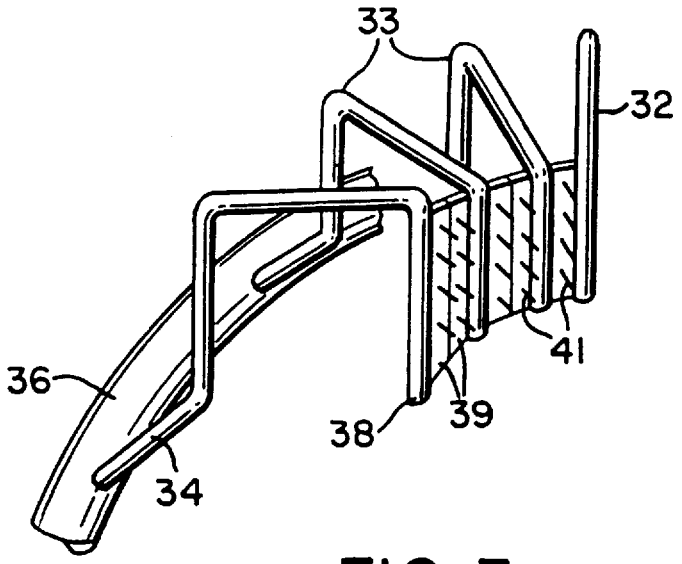
FIG. 3 is a segmentary view of the throat section's internal support and cooling structure.
Figure 4:
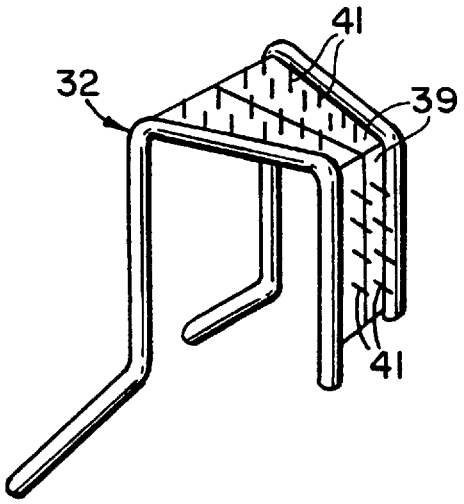
FIG. 4 is a segmentary view of FIG. 3.

Referring also to FIGS. 2, 3 & 4, throat section 31 of gasifier 10 is in essence a continuation of the gasifier floor 19 refractory liner 22. Throat 31 is thus formed basically of a refractory material capable to a large extent of withstanding the high process temperatures as well as the effects of moving slag which flows from the combustion chamber walls and floor, into bath 26. The throat includes a central axis which is positioned preferably in a substantially vertical disposition.

Physically, throat section 31 is comprised of an internal framework of conductors or pipes 32 usually structured of high grade steel or the like. In a preferred embodiment, the pipes are equally spaced about throat vertical opening 21 in segments 33 that radiate outwardly, and are connected at their respective remote or inlet ends 34 to a manifold 36. The latter is communicated by a conductor 37 to the pressurized source 42 of coolant water and can be embedded within, or is external to the throat refractory.

Each pipe section 32 includes an inner, vertical component that lies substantially parallel to the throat opening 21 central axis. The upper part of each of said pipe sections 32 can be angled upwardly to define a cooling channel contiguous to the gasifier floor 19. A third section of the cooling channel extends downwardly, terminating in a discharge pipe 38.

As noted above, each segment 33 of discharge pipe 38 preferably circulates water as the coolant, and is arranged to direct heated coolant directly into the water bath 26. This water flow, however, must be monitored to assure that an adequate, though not excessive level of water is maintained in bath 26 during the deslagging, as well as during gas producing phases of operation.

After cooling water is passed through pipe framework 32, it is preferably discharged through pipe 38 into water bath 26. Alternately however, exiting hot water from the framework could be introduced to quench ring 27 from which it would then be directed against dip tube 24 wall.

The throat section 31 interior pipe framework 32 can be rigidized by webbing 39 or by external longitudinal vanes which extend outwardly from the pipe exterior surface such that adjacent pipe sections can be welded together into a composite structure.

The heat resistant annular part or body of throat section 31 is comprised of a castable refractory which is initially sufficiently pliable to be forced between and about the rigidized pipe framework 32 and mechanically rammed into the desired figuration to dimensionally conform to the gasifier floor 19 and its refractory layer 23 or coating. Although the castable refractory will harden into a solid mass, it can be strengthened by refractory anchors 41 which are judicially spaced, and which depend outwardly from webbing 39 or from the pipe structure, to support the refractory.

In molding the castable refractory material to the supporting pipe framework 32, the throat facing surface can be contoured with at least one slag drip point or ring 43 which promotes downward flowing slag to detach from the throat wall and to fall into water bath 26. Structurally, the gasifier throat section 31 can be fastened into floor 19 as original equipment, or can be installed as a detachable and replaceable element in the floor structure. Thus, it can be structured to be removable from gasifier floor 19 and provisionally held in place by the gasifier's steel supporting floor, as well as by bolts which extend into the floor itself.

It is understood that although modifications and variations of the invention can be made without departing from the spirit and scope thereof, only such limitations should be imposed as are indicated in the appended claims.

We claim:

1. A gasifier for the partial oxidation of a carbonaceous fuel mixture to provide an effluent, including a synthesis gas, comprising:

a combustion chamber for receiving and partially oxidizing said carbonaceous fuel mixture, said combustion chamber having a floor;

a bath section below said floor of said combustion chamber for holding a liquid coolant;

a throat section at said chamber floor, said throat section having a throat opening through which said combustion chamber communicates with said bath section to conduct products of said partial oxidation from said combustion chamber into said bath section, said throat section including an internal cooling system communicating with a source of a liquid coolant; and means for circulating said liquid coolant through said cooling system.

2. The gasifier of claim 1, wherein said liquid coolant circulating means includes a network of pipes embedded in a refractory material.

3. The gasifier of claim 2, wherein said network of pipes includes a plurality of discrete pipe sections, each section having a liquid coolant discharge outlet and a liquid coolant inlet communicating with said source of liquid coolant.

4. The gasifier of claim 3, wherein said source of liquid coolant comprises a common manifold.

5. A gasifier for the partial oxidation of a carbonaceous fuel mixture to provide an effluent, including a synthesis gas, comprising:

a combustion chamber for receiving and partially oxidizing said carbonaceous fuel mixture, said combustion chamber having a floor;

a bath section below said floor of said combustion chamber for holding a liquid coolant; and a throat section at said chamber floor, said throat section having a throat opening through which said combustion chamber communicates with said bath section, wherein said floor includes a conical shape which narrows toward said bath section.

6. The gasifier of claim 5, wherein said throat section includes an internal cooling system communicating with a source of liquid coolant.

7. The gasifier of claim 6, additionally comprising means for circulating said liquid coolant through said cooling system.

8. The gasifier of claim 7, wherein said liquid coolant circulating means includes a network of pipes embedded in a refractory material.

9. A gasifier for the partial oxidation of a carbonaceous fuel mixture to provide an effluent, including a synthesis gas, comprising:

a combustion chamber for receiving and partially oxidizing said carbonaceous fuel mixture, said combustion chamber having a floor;

a bath section below said floor of said combustion chamber for holding a liquid coolant;

a throat section at said chamber floor, said throat section having a throat opening through which said combustion chamber communicates with said bath section to conduct products of said partial oxidation from said combustion chamber into said bath section, said throat section having a substantially vertical, upper wall, an angled, middle wall widening from said upper wall toward said bath section, and a substantially vertical, lower wall extending from said middle wall.

10. The gasifier of claim 9, wherein said throat section includes an internal cooling section communicating with a source of liquid coolant.

11. The gasifier of claim 10, additionally comprising means for circulating said liquid coolant through said cooling system.

12. The gasifier of claim 11, wherein said liquid coolant circulating means includes a network of pipes embedded in a refractory material.

13. The gasifier of claim 12, wherein each of said pipes includes portions parallel and adjacent to said throat section upper wall, middle wall and lower wall.

14. The gasifier of claim 13, wherein each of said pipes additionally includes a portion extending from said upper wall and contiguous with said floor.

* * * * *

UNITED STATES PATENT AND TRADEMARK OFFICE

CERTIFICATE OF CORRECTION

PATENT NO. : 5,851,497

DATED : December 22, 1998

INVENTOR(S) : Donald Duane BROOKER et al

It is certified that error appears in the above-identified patent and that said Letters Patent is hereby corrected as shown below:

In Column 2, line 8, change "he" to --the--

In Column 2, line 67, after "component", insert --33--

Signed and Sealed this

Thirteenth Day of July, 1999

*Attest:*

*Attesting Officer*

Q. TODD DICKINSON

*Acting Commissioner of Patents and Trademarks*